US005419678A

United States Patent [19]

Erb

[11] Patent Number: 5,419,678

[45] Date of Patent: May 30, 1995

[54] CONTROL ARRANGEMENT FOR AN APPARATUS FOR DELIVERING PRINTING PRODUCTS

[75] Inventor: Pirmin Erb, Jona, Switzerland

[73] Assignee: Ferag AG, Hinwil, Switzerland

[21] Appl. No.: 131,138

[22] Filed: Oct. 4, 1993

[30] Foreign Application Priority Data

Oct. 5, 1992 [CH] Switzerland ..... 03 098/92

[51] Int. Cl.[6] ..... B65G 59/06; B65H 3/08

[52] U.S. Cl. ..... 414/797; 271/3.1; 414/788.8

[58] Field of Search ..... 271/3.1, 270, 265, 258, 271/69, 176, 202; 414/926, 797, 788.8, 794.9

[56] References Cited

U.S. PATENT DOCUMENTS

| | | | |
|---|---|---|---|
| 4,133,523 | 1/1979 | Berthelot | 271/202 |
| 4,320,894 | 3/1982 | Reist et al. . | |
| 4,667,953 | 5/1987 | Hirakawa et al. | 271/202 |
| 4,765,790 | 8/1988 | Besemann | 414/926 |

FOREIGN PATENT DOCUMENTS

| | | |
|---|---|---|
| 0551601 | 1/1992 | European Pat. Off. . |
| 0567807 | 11/1993 | European Pat. Off. . |
| 630583 | 6/1982 | Switzerland . |
| 2260123 | 7/1993 | United Kingdom . |

OTHER PUBLICATIONS

"*Regeln und Steuern mit unscharfer Logik*", by Marcel Jacomet in TR TECHNISCHE RUNDSCHAU, Issue 19, 1992, pp. 94–97.

*Primary Examiner*—Andres Kashnikow
*Assistant Examiner*—Christopher G. Trainor
*Attorney, Agent, or Firm*—Bell, Seltzer, Park & Gibson

[57] ABSTRACT

A control arrangement for an apparatus for delivering printing products (2) to a further processing point has a sensor (LS1) for registering a predetermined height of the upper side (29*a*) of an intermediate stack (29), which has been formed against a stop (11) from printing products fed in a series formation (S) by means of a first conveying device (1), and acts on a drive (M2) of a rocker (5), which carries this intermediate stack (29), such that the rocker is lowered and raised in order to keep the upper side (29*a*) of the intermediate stack (29) essentially at the predetermined height. A first controller (R1) drives the drive (M2) of the rocker (5) at adjustable speed in a range between two lifting limits of the rocker (5). A second controller (R2) forms with a set value ($n3_s$), dependent on the registered lifting movement, a manipulated variable ($n3_f$) for the speed of the drive (M3) of the first conveying device (1) and thus controls in dependence on the lifting movement of the rocker (5) the volume of printing products per unit of time which is fed to the intermediate stack (29) by the first conveying device (1).

11 Claims, 3 Drawing Sheets

CONTROL ARRANGEMENT FOR AN APPARATUS FOR DELIVERING PRINTING PRODUCTS

DESCRIPTION

Figure 1:
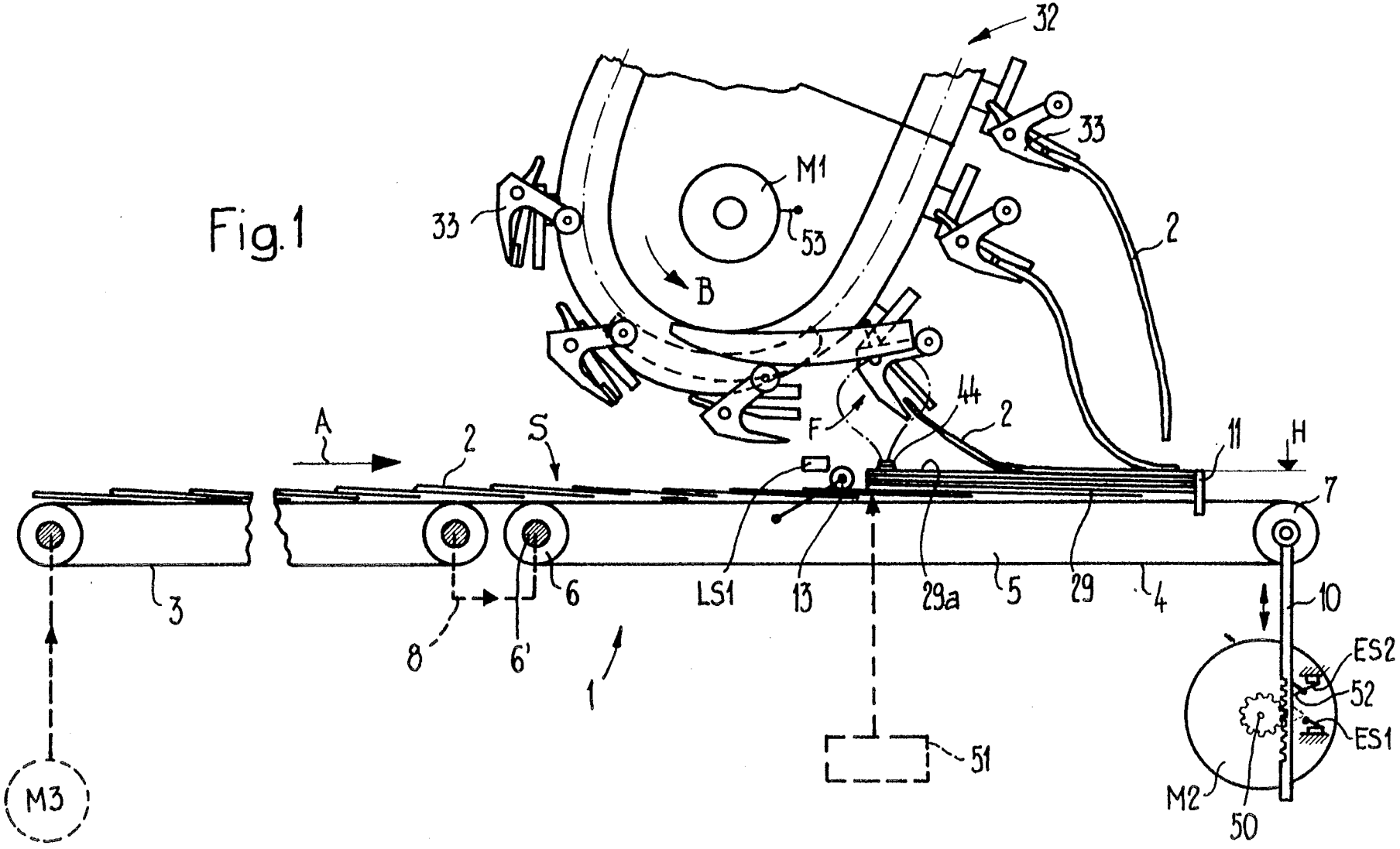

The invention relates to a control arrangement for an apparatus for delivering printing products to a further processing point, having a first conveying device for feeding the printing products in a series formation, having a second conveying device for taking over and further transporting the fed printing products and having a rocker arranged in the conveying region of the first conveying device, an intermediate stack, charged from below, being formed on the rocker from the fed printing products against a stop, from which stack in each case the uppermost printing product is transferred by a raising device to the second conveying device, and the control arrangement registering with a sensor a predetermined height of the upper side of the intermediate stack and, by acting on a drive of the rocker, lowering and raising the latter and thus keeping the upper side of the intermediate stack essentially at the predetermined height.

Such a control arrangement is part of an apparatus of the abovementioned type which is the subject of GB-A-2260 123, or of the equivalent EP-A-0 551 601.

In the relevant prior art there is an apparatus for delivering printing products to a further processing point (CH-A-630 583 and corresponding US-A-4 320 894), in which an excessive distance between two printing products in the fed series formation may have the effect that certain products arrive too late at the transfer region and consequently miss an assigned gripper of the second conveying device, which then arrives empty at the further processing point. Since such an irregular occurrence of printing products at the further processing point may have disadvantageous effects, it is intended by the abovementioned older proposal of the applicant to design the apparatus for delivering printing products to a further processing point such that it allows the printing products to be fed in the desired sequence to a further processing point irrespective of the quality of the fed series formation. Due to the fact that the fed printing products according to the older proposal of the applicant are first of all pushed into an intermediate stack, the feeding of the printing products to the second conveying device is to a certain extent decoupled from the feed of the printing products by the first conveying device, so that excessive or inadequate distances or gaps between successive printing products or congregations of an imbricated stream (if as in the case of the older proposal the series formation is an imbricated formation, in which each printing product rests on the following one) and even missing printing products in the series formation no longer influence the correct feeding of printing products to the second conveying device, that is to say the intermediate stack compensates for irregularities in the fed series formation.

The control arrangement according to the older proposal, which thereby registers a predetermined height of the upper side of the intermediate stack and, by acting on a drive of the rocker, lowers and raises the latter and thus keeps the upper side of the intermediate stack essentially at the predetermined height, has a height monitoring control, with the aid of which the upper side of the intermediate stack is kept essentially at the predetermined height in the manner of a two-step control. In this way, although allowance can be made for the change in height position of the upper side of the intermediate stack which is caused by irregularities in the given series formation, allowance cannot be made for the rate of change in height, which is dependent on the volume of printing products fed per unit of time by the first conveying device.

A vivid example of the recent prior art for this is to be found, for example, in the article "Regeln und Steuern mir unscharfer Logik" (Closed-loop and open-loop control with fuzzy logic) by Marcel Jacomet in TR TECHNISCHE RUNDSCHAU, issue 19, 1992, pp. 94–97. Described therein is a case study on the industrial suitability and the application possibilities of fuzzy logic in the example of a so-called print-roll machine, which in the periodicals sector serves as an intermediate store for the printed sheets of a periodical, which after the printing machine are wound up as an imbricated stream directly onto rolls and are kept thus in store rooms until final production. In order to achieve an exact synchronization with a central production cycle and to compensate for irregularities in the imbricated stream to be fed, use is likewise made of an intermediate stack, the height of which is to be controlled to as constant a level as possible. The intermediate stack is, however, charged from above, and in each case the lowermost printing product is taken from the intermediate stack. Although this intermediate stack principle is very simple, it is limited in its application possibilities. An intermediate stack principle as in the case of the older proposal of the applicant, in which the intermediate stack is charged from below, is more versatile, but also more difficult to control. A series of twenty-four sensors, arranged one above the other, measures at the print-roll machine the level height, from the derivation of which the rate of change in the level height is additionally determined. This known system consequently necessarily requires a considerable height of the intermediate stack in order that its height and the change in height can be determined by the sensors. This in turn has the consequence that the intermediate stack has a considerable weight and thus can hinder the removal of the respectively lowermost printing product. In the case of this system, in spite of the simple intermediate stack principle, the control arrangement is complex, because it does not operate with a pure fuzzy controller, already complex in itself, but with a hybrid solution, in which a fuzzy control is superposed on a conventional digital PI controller.

The object of the invention is to design a control arrangement of the type mentioned at beginning such that, in the controlling operation, allowance can be made for changes in the volume of printing products which is fed per unit of time to the intermediate stack by the first conveying device, in a simple way and while retaining a low height of the intermediate stack and consequently a low weight of the same and a small lifting range of the rocker.

To achieve this object, a control arrangement of the type mentioned at the beginning comprises a first controller, which drives the drive of the rocker at adjustable speed in a range between two lifting limits of the rocker, an actual-value sensor for registering the lifting movement of the rocker, and a second controller, which forms with a set value dependent on the registered lifting movement a manipulated variable for the speed of the drive of the first conveying device and thus controls in dependence on the lifting movement of the rocker the volume of printing products per unit of time which is fed to the intermediate stack by the first conveying device.

In the case of the control arrangement according to the invention, the rocker driven at adjustable speed is moved in a subrange between its two lifting limits, that is to say in a range which usually does not reach as far as the two lifting limits, and with the lifting movement thereby registered a set value for the second controller is formed, which controls the speed of the drive of the first conveying device. In other words, the lifting control of the rocker is used according to the invention for controlling the feeding speed. This means that, for example when feeding thick printing products, a greater lifting movement is obtained for the subrange within the two lifting limits of the rocker and consequently a greater set value and hence in turn a greater speed of the first conveying device are obtained than in the case in which thin printing products are processed. In dependence on the volume of printing products fed by the first conveying device, the height of the upper side of the intermediate stack is thus controlled quickly or slowly, i.e. thicker printing products are subsequently delivered by the first conveying device more quickly than thinner printing products, in order for example to close gaps in the series or imbricated formation more quickly or more slowly. The invention consequently provides an adaptive control arrangement which automatically allows for changes in the fed volume of printing products in a simple way. The stack height can in this case remain small, as in the case of the older proposal of the applicant, which means a low weight of the intermediate stack and thus facilitates the charging from below of the intermediate stack.

Advantageous developments of the invention form the subjects of the subclaims.

In a development, the control arrangement according to the invention comprises two limit switches, which fix the maximum upper and maximum lower lifting limit, respectively, of the rocker for safety and initialization purposes and, upon actuation, in each case switch off or reverse the drive of the rocker. In operation, the rocker is moved constantly back and forth within the abovementioned subrange between the two maximum lifting limits, but usually not as far as the maximum lifting limits, but only to the extent that or only to the point in time at which the predetermined height of the upper side of the intermediate stack has been reached again. Thus, if the initialization phase is disregarded, the limit switches are not involved in the controlling operation. They serve primarily for safety. The sensor sets the zero point for the said subrange.

A further development concerns the control arrangement according to the invention wherein the first controller has a first input for entering a set value for the adjustable speed of the drive of the rocker. By means of this input, the speed of the drive of the rocker can be predetermined according to operating requirements in the rest of the installation.

Yet a further development concerns the control arrangement according to the invention wherein the first input of the controller is connected to a speed signal output of a drive of the second conveying device. Thus, the lifting movement speed of the rocker to be registered for the controlling operation can be synchronized in a simple way with the drive of the second conveying device, which feeds the printing products to the further processing point.

Yet a further development concerns the control arrangement according to the invention wherein the first input of the first controller is connected to a potentiometer serving as a set-value generator. This development, which may be provided separately from or additionally to the abovementioned further development, allows the set value for the first controller to be predetermined independently of the further processing system or with proportional amplification or attenuation.

Yet a further development concerns the control arrangement according to the invention wherein the sensor is designed as a light barrier and acts via the first controller on the drive of the rocker in such a way that, with interrupted light beam, the rocker is moved downward and, with non-interrupted light beam, the rocker is moved upward, or vice versa. Thus, if the light beam is interrupted (or cleared) by the intermediate stack, the direction of movement of the rocker is reversed, and the rocker is moved downward until the light barrier is clear again (or interrupted again) whereupon the rocker is again moved upward until the light beam is interrupted again (or cleared again), etc. Thus, while retaining the light barrier as it is provided according to the older proposal of the applicant, it is possible to influence the speed of the drive of the first conveying device in a simple way in order to eliminate quickly the cause of the change of intermediate stack height.

Yet a further development concerns the control arrangement according to the invention wherein the actual-value sensor is a pulse generator, which emits at an output a pulse sequence dependent on the magnitude and the direction of the lifting movement of the rocker. This permits a particularly simple and expedient evaluation of the lifting movement speed of the rocker.

Yet a further development concerns the control arrangement according to the invention wherein the output of the actual-value sensor is connected at least to a second input of the first controller. In this case, the lifting movement of the rocker, registered as a pulse sequence, may serve to determine for the operation of controlling the speed of the drive of the rocker the actual value of this speed. If a motor with adjustable constant speed were used as the drive for the rocker, the abovementioned registering of the actual value of the speed could be dispensed with, so that a simple speed control device could be used instead of the first controller.

Yet a further development concerns the control arrangement according to the invention wherein the output of the actual-value sensor is connected to a detector circuit, which has a decoder for detecting the lifting movement direction and a counter for counting the pulses from the first actual-value sensor, and wherein the detector circuit is connected via a D/A converter to a set-value input of the second controller and delivers to the latter the set value, from which the second controller forms the manipulated variable for the speed of the drive of the first conveying device by comparison with its actual speed value. This is an expedient development of the invention for evaluating the pulse sequence corresponding to the lifting movement of the rocker in terms of magnitude and direction. Depending on the direction of rotation, the pulse sequence controls the counter such that it counts forward or backward, so that the set value which is fed to the second controller is varied correspondingly, for example as the voltage or as the frequency at the output of the D/A converter.

In yet a further development, the control arrangement according to the invention comprises a set-value adjusting device, which is connected between the D/A converter and the set-value input of the second controller and which, in yet a further development of the control arrangement according to the invention, may be a potentiometer. With the latter, the set value can be additionally changed proportionally, depending on the arriving imbricated stream.

Figure 2:
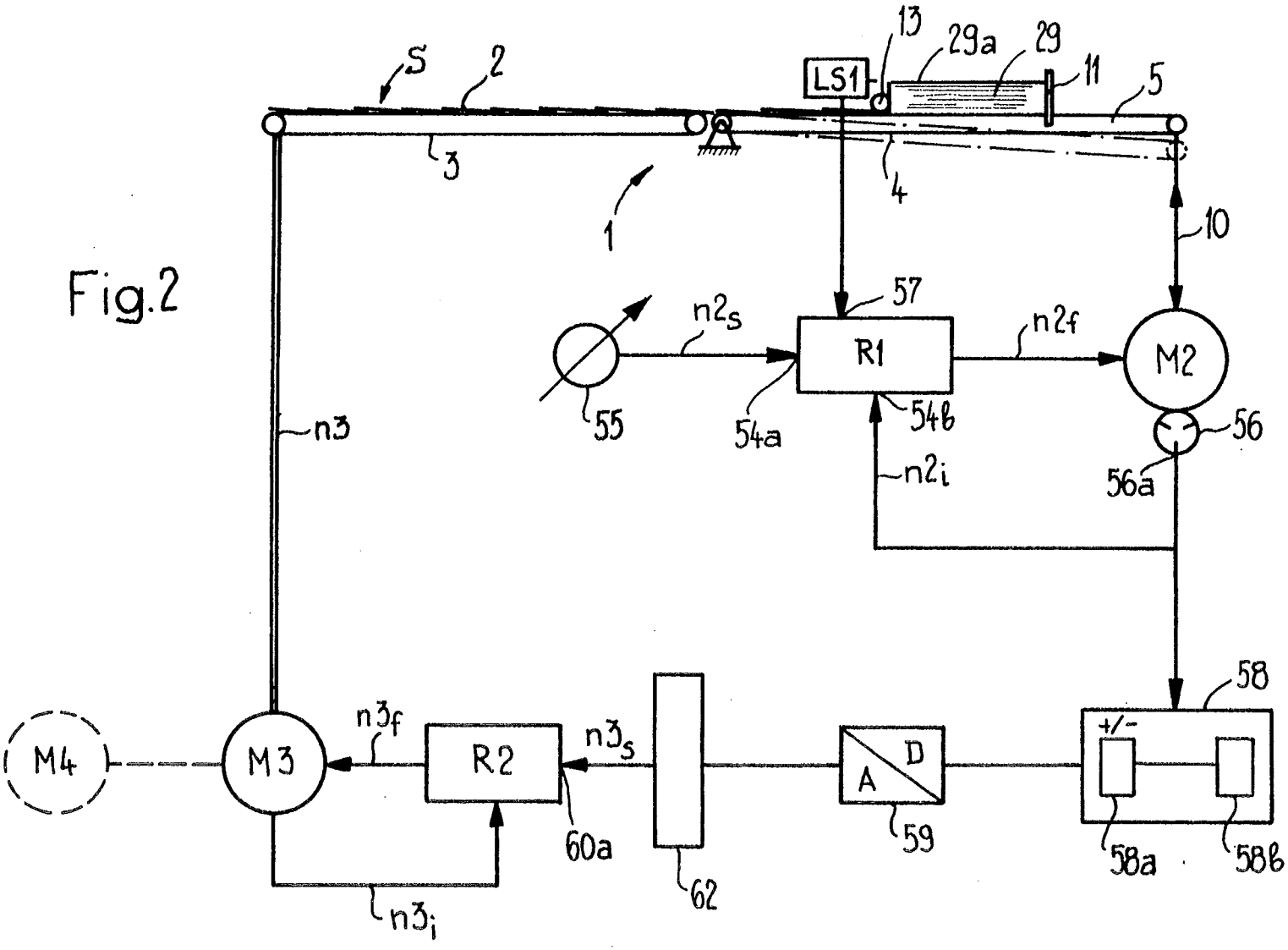
Figure 3:
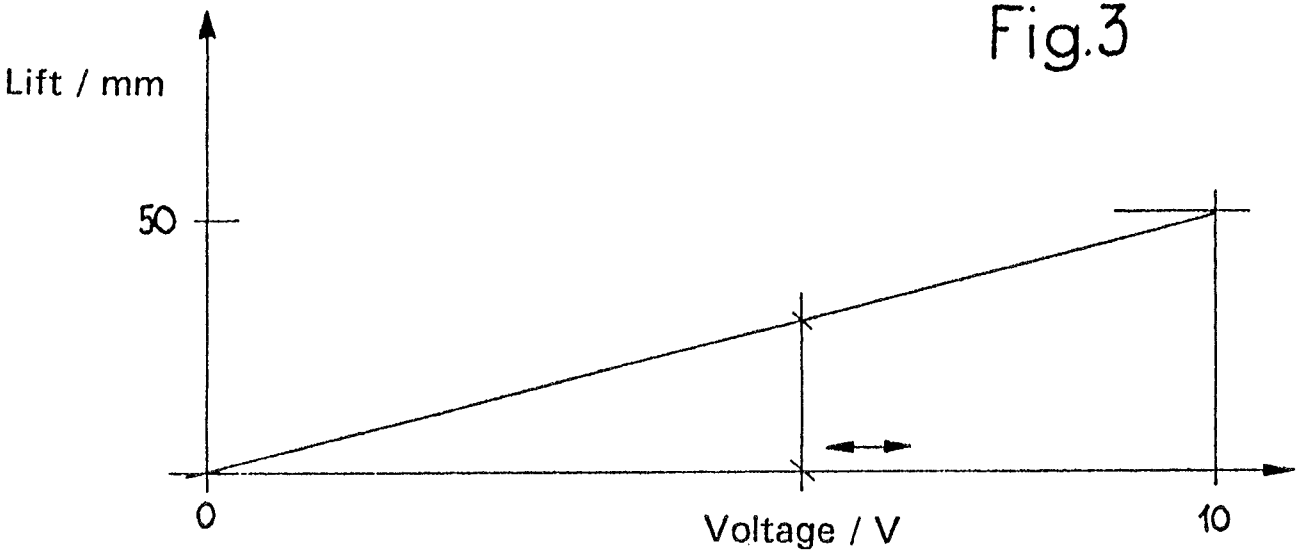

An illustrative embodiment of the invention is described in more detail below with reference to the drawings, in which:

FIG. 1 shows an apparatus for delivering printing products to a further processing point, in which a control arrangement according to the invention is used, FIG. 2 shows a block diagram of the control arrangement according to the invention, and FIG. 3 shows a diagram in which the lift of a rocker, represented in FIGS. 1 and 2, is plotted against an electric voltage corresponding to it.

According to the representation in FIGS. 1 and 2, an apparatus for delivering printing products to a further processing point has a first conveying device 1, which delivers printing products 2 in an imbricated formation S. In this case, each printing product 2 in this imbricated formation S rests on the following printing product 2. Instead of specifically in an imbricated formation, as represented here, the printing products could be delivered by the first conveying device generally in any other series formation, thus for example in a series in which there are gaps between neighboring printing products. The imbricated formation itself could also have gaps, intentionally or unintentionally.

The conveying device 1 has a belt conveyer 3 and a strap conveyer 4 arranged downstream of the latter. The strap conveyer 4 is formed by a number of round straps which run parallel to and at a distance from one another and which are led via deflecting rollers 6 and 7, of which one deflecting roller is driven, preferably by one and the same drive M3 as the belt conveyer 3 via a drive connection 8, indicated by dashed lines. The belt conveyor 3 and the strap conveyor 4 may have the same conveying speed. The strap conveyor 4 is part of a rocker, denoted in its entirety by 5. The rocker 5 is on the one hand pivotable about a spindle 6' of the deflecting roller 6 and on the other hand supported on a toothed rack 10, only diagrammatically represented in FIG. 1. By means of the toothed rack 10, which meshes with a pinion 50, the pivoting position of the rocker 5 is adjusted in a way still to be described.

The gear arrangement, comprising toothed rack and pinion, used in the illustrative embodiment described here for adjusting the pivoting position of the rocker 5, serves merely for the purposes of illustration. Instead of this gear arrangement, a lifting spindle gear could readily be used, the lifting spindle of which replaces the toothed rack and is driven by a worm drive.

Arranged above and in the end region of the strap conveyor 4 is a stop 11 which has a number of stop fingers (of which only the front one is visible in FIGS. 1 and 2), which are arranged at a distance from one another and extend in each case through between two round straps. Seen in conveying direction A, before the stop 11 there is provided a conveying roller 13, which extends transversely to the conveying direction A and rests on the imbricated formation S. The conveying roller 13, which can be driven by the drive M3 via a drive connection, likewise not represented, exerts on the printing products 2 a conveying effect. Thanks to its floating mounting, it can adapt itself to a changing height of the imbricated formation S.

Between the conveying roller 13 and the stop 11, the printing products 2 are piled up to form an intermediate stack 29. Arranged underneath the round straps in the region of the intermediate stack 29 is a supporting plate (not shown) which prevents the round straps being able to sag under the weight of the intermediate stack 29. The printing products 2 are pushed by the strap conveyor 4 from below into the intermediate stack 29. The driven conveying roller 13 in this case supports the pushing of the printing products 2 into the intermediate stack 29. The pushing-forward movement of the printing products 2 is retarded by the stop 11.

If, as in the illustrative embodiment represented here, the printing products 2 are fed to the intermediate stack 29 as a gapless imbricated stream, it presents no difficulties to push the printing products into the intermediate stack at the bottom. For the eventuality that the imbricated stream has gaps or that the printing products 2 are fed in a series formation with mutual gaps, precaution must be taken that the underside of the intermediate stack 29 always has such a height above the strap conveyor 4 and the supporting plate (not shown), at least on the left-hand side of the intermediate stack in FIG. 1, that each successive printing product can be pushed under the intermediate stack 29. For this purpose, a lifting apparatus 51 is indicated, which can be operated cyclically, for example cycle-controlled by the printing products arriving at the intermediate stack.

Instead of the lifting apparatus 51, a similar apparatus (not shown) may be used, such as that which is the subject of a further older proposal of the applicant (European Patent Application No. 93 105 576.8 of Apr. 3, 1993 and corresponding U.S. patent application No. 08/053 918 of Apr. 27, 1993). If this apparatus according to the further older proposal were to be used, an auxiliary belt equipped with an adhesive surface, which belt together with the first conveying device would form a conveying nip narrowing towards the intermediate stack, would in each case raise the rear edge of a printing product bearing against the stop 11 up to a further stop, which in the present case would be located on the left-hand side of the intermediate stack in FIG. 1. At this further stop, the rear edges of printing products already located in the intermediate stack would be raised up. By continuous pushing in of printing products through the conveying nip, the intermediate stack would be produced between the two stops, during the course of which gaps of the running-in imbricated stream or - more generally - of the fed series formation would be closed and the cycle thereof would be discontinued. This raising of the intermediate stack for introducing the lowermost printing product would, of course, have to be allowed for in the registering of the height H of the intermediate stack.

A sensor in the form of a light barrier LS1 is part of a control arrangement which is described in more detail below with additional reference to FIG. 3 and which essentially maintains a predetermined height H of the upper side 29a of the intermediate stack 29 by registering the lowering and raising of the rocker by a drive M2.

According to the representation in FIG. 1, arranged above the rocker 5 is a second conveying device 32, which has individually controllable grippers 33, which are fastened at regular intervals on an endlessly circulating chain (not shown), which runs in the direction of an arrow B. In order to bring the printing products 2 from the intermediate stack 29 into the conveying region F of the conveying device 32, i.e. into the path of movement of the opened grippers 33, a raising device is provided in the form of a sucker arrangement which can be moved up and down and is denoted overall by 44. The respectively uppermost printing product 2 in the intermediate stack 29 is seized by the sucker arrangement 44 and taken along upward into the conveying region F of the conveying device 32. The printing products 2 are consequently brought by their edges to the path of movement of in each case an open gripper 33, which is subsequently closed in a way not of interest here. The printing products 2 seized by the grippers 33 are then further lifted completely off the intermediate stack 29 and taken upward to a further processing point (not shown). Due to the fact that the printing products 2 fed by the belt conveyor 3 are not fed directly to the grippers 33 succeeding one another at fixed intervals, but to the intermediate stack 29, any irregularities in the imbrication spacing, i.e. in the distance between successive printing products 2 in the imbricated formation S and missing printing products 2 in the imbricated formation S have no influence on satisfactory taking over by the grippers 33, albeit on condition that the predetermined height H of the upper side 29a of the intermediate stack 29 is essentially maintained by the control arrangement now described below.

The taking away of the printing products by means of the conveying device 32 from the intermediate stack 29 can likewise be controlled, and this controlling operation can be allowed for in the feeding of printing products to the intermediate stack 29. If, for example, no printing product is removed from the intermediate stack by a certain time interval, or only a certain number are removed per unit of time, the drive of the first conveying device can be correspondingly acted upon to allow for this as well, in order that the first conveying device is fed nothing or less than otherwise for this time interval. Since the upper side 29a of the intermediate stack 29 remains at the height H for a set time interval, the reaction on the drive of the first conveying device for controlled taking away as well readily emerges from the following description of the operating principle of the control arrangement.

According to the representation in FIG. 2, the control arrangement has a first controller R1, in the control loop of which the drive M2 for the lift of the rocker 5 lies, and a second controller R2, in the control loop of which the drive M3 of the first conveying device 1 lies. In the following description, it is assumed that the drives M2 and M3 are electric motors. Seated on the output shaft of the drive M2 is the pinion 50, which meshes with the toothed rack 10, as is diagrammatically represented in FIG. 1. Upon rotation of the pinion 50 clockwise in the initialization phase, the toothed rack 10, and consequently the rocker 5, are moved downward until a stop 52 fastened on the toothed rack 10 actuates a stationary limit switch ES1. The latter thereby reverses the drive M2, so that the pinion 50 rotates counter-clockwise and moves the toothed rack 10, and consequently the rocker 5, upward again, but now with the controlling operation commencing, so that the stop 52 usually does not reach a limit switch ES2. The movement of the drive M2, and consequently the lifting movement of the toothed rack 10, are then controlled with the aid of the light barrier. The limit switches ES1 and ES2 may lie in a control circuit of the first controller R1 and thus cause the latter to reverse or switch off the drive M2, which is not specifically represented in FIG. 2.

Apart from the initializing of the control arrangement, the limit switches serve as safety disconnectors. In addition or instead of the limit switches, mechanical stops may be provided for this (not shown).

The first controller R1 causes the drive M2 to be driven at selectable speed. For this, a first input 54*a* of the first controller R1 is connected to a potentiometer 55, which serves as the set-value generator and delivers a set value $n2_s$. Instead of this or in addition, the first input 54*a* of the first controller R1 could be connected to a speed signal output 53 (see FIG. 1) of the drive M1 of the second conveying device 32 (FIG. 1). If the drive M2 were a drive with adjustable constant speed, instead of the first controller R1 a simple control device (that is to say without feedback) could also be used if the rocker is to be moved at adjustable, but constant speed. In the case represented here, the first controller R1 receives an actual value $n2_i$ of the speed of the drive M2, in a way described in more detail below, at a second input 54*b* and, by comparison with the set value $n2_s$, forms a manipulated variable $n2_f$ for the drive M2. A third input 57 of the first controller R1 is connected to an output of the light barrier LS1. This connection serves for controlling the reversal in the direction of rotation of the drive M2 as soon as the light beam of the light barrier is interrupted or no longer interrupted (or vice versa), as described in even more detail further below in connection with the operating principle of the control arrangement.

The drive M2, which could also be an electrohydraulic actuator, is in this case a brushless, electronically commutated DC motor with integrated rotor-positioned sensor, which also delivers a tacho signal, used by the first controller R1 as a tacho signal, that is to say as the actual value $n2_i$. The controllers R1 and R2 used here are pulse-duration modulated controllers, the controls being designed for both directions of rotation. Hall generators fitted into the drives M2 and M3 serve as the rotor-position sensors. The rotor-position sensor is diagrammatically represented in FIG. 2 as a separate actual-value sensor 56. The actual-value sensor 56 or rotor-position sensor is, considered in its overall function, a pulse generator which emits at an output 56*a* a pulse sequence dependent on the magnitude and the direction of the lifting movement of the rocket 5. The output 56*a* of the actual-value sensor 56 is, as presented, connected to the second input 54*b* of the first controller R1.

The output 56*a* of the actual-value sensor 56 is connected to a detector circuit, denoted overall by 58, which has a decoder 58*a* for detecting the lifting movement direction of the rocker 5 and a counter 58*b* for counting the pulses from the actual-value sensor 56. The detector circuit 58 is connected via a digital/analog(-D/A) converter 59 to a set-value input 60*a* of the second controller R2 and delivers to the latter a set value $n3_s$, from which the second controller R2 forms a manipulated variable $n3_f$ for the speed n3 of the drive M3 of the first conveying device 1 by comparison with its actual speed value $n3_i$, as is diagrammatically represented in FIG. 2 and is self-explanatory. The decoder 58*a* is an integrated circuit which detects the direction of rotation of the drive M2 on the basis of the pulse sequence and makes the counter count forward or backward such that the set value $n3_s$ varies between 0–10 volts according to the characteristic curve in FIG. 3 with an assumed lift of 50 mm. By a set-value adjusting device 62, in the form of a potentiometer or the like, connected between the D/A converter 59 and the set-value input 60*a* of the second controller R2, the set value can if required be additionally changed proportionally, depending on the incoming imbricated stream.

The control arrangement operates as follows:

In an initialization phase, the first controller R1 switches on the drive M2, which moves the toothed rack 10 downward until the limit switch ES1 is actuated, whereupon the direction of rotation of the drive M2 changes and the latter then moves the toothed rack 10 upward. Then the height-controlling phase begins, in which the height H of the upper side 29*a* of the intermediate stack 29 is to be registered and essentially maintained. For this, the detector circuit 58 and the D/A converter 59 begin registering the pulses from the actual-value sensor 56 and forming the set value for the drive M3. For this purpose, when the direction of rotation changes to upward, the counter 58*b* starts counting the pulses from the actual-value sensor 56. It is assumed that an intermediate stack 29 has already been formed at the stop 11. If the light beam of the light barrier LS1 is then interrupted by the intermediate stack at the height H, the direction of rotation of the drive M2 is reversed again (as mentioned usually before actuation of the upper limit switch ES2), so that said drive moves the toothed rack 10 downward until the light barrier LS1 is clear again, whereupon the direction of rotation of the drive M2 is reversed again (this time by means of the controller R1, that is to say without the assistance of the limit switch ES1), and the drive M2 moves the toothed rack 10 upward again until the light beam of the light barrier LS1 is interrupted again, etc. The decoder 58*a* thereby detects the direction of rotation on the basis of the pulse sequence and controls the counter forward-/backward such that the set value $n3_s$ varies in a subrange between 0–10 volts, that is to say for example between 0 and 8 volts, the size of this subrange being dependent on how great the lifting movement has been between in each case two reversals in the direction of rotation of the drive M2. The greater this lifting movement was, the greater the set value $n3_s$, and the more the speed n3 of the drive M3 of the first conveying device 1 increases in order to fill up the intermediate stack 29 again all the quicker. The control arrangement consequently controls the feeding speed of the first conveying device 1 by height control of the rocker 5. When the control arrangement is switched off, the drive M2 moves the toothed rack 10 downward until the counter reading is zero.

If the imbricated stream comprises, for example, individual sheets, a small lifting movement is executed between two reversals in the direction of rotation of the drive M2, which produces a small set value $n3_s$ for the drive M3, so that the speed n3 requires merely a slight correction, i.e. the first conveying device 1 can run slowly. If, on the other hand, the imbricated stream comprises thicker printing products, greater and faster lifting movements are required, which produce greater values of the set value $n3_s$ and consequently result in acceleration of the first conveying device 1. This is important in order that the first conveying device 1 subsequently supplies thicker printing products more quickly in order to be able to fill up the intermediate stack correspondingly more quickly. If, finally, it is assumed that, for whatever reason, no printing product is taken from the intermediate stack, but the intermediate stack continues to be filled up, this has the result in the lower end position of the toothed rack 10 of switching of the control arrangement, because an upward movement of the toothed rack 10 would not be possible after reversal of the direction of rotation, since the light barrier LS1 would immediately switch again to reversal of the direction of rotation. Consequently, the output signal of the counter remains zero and hence the set value $n3_s$ remains zero, which stops the drive M3.

The supplying of the belt conveyor 3 with printing products 2 is usually performed by a so-called DISC system or by some other storage unit or by bundle charging. Also possible, however, is manual charging by means of a manual system. Each drive M4 is indicated by dashed lines in FIG. 2, the manual system itself is not represented. It could comprise a belt conveyor similar to the belt conveyor 3, which is provided instead of the latter or in addition to the latter. In the first case, the drive M4 would take the place of the drive M3, in the latter case the drives M3 and M4 would both be provided and would be used alternatively, as required.

Finally, it is possible within the scope of the invention to design the stop 11 adjustably, which has likewise not been represented in detail.

I claim:

1. A control arrangement for an apparatus for delivering printing products (2) to a further processing point, having a first conveying device (1) which includes a drive (M3) for feeding the printing products (2) in a series formation (S), a second conveying device (32) for taking over and further transporting the fed printing products (2), and a rocker (5) arranged in the conveying region of the first conveying device (1), an intermediate stack (29), charged from below, being formed on the rocker (5) from the fed printing products (2) against a stop (11), from which stack in each case the uppermost printing product transferred by a raising device (44) to the second conveying device (32), and the control arrangement comprising a sensor (LS1) for sensing a predetermined height (H) of the upper side (29*a*) of the intermediate stack (29), a drive (M2) for lowering and raising the rocker (5) and thus keeping the upper side (29*a*) of the intermediate stack (29) essentially at the predetermined height, a first controller (R1) responsive to said height sensor (LS1) and connected to the drive (M2) of the rocker (5) for operating the drive (M2) at an adjustable speed in a range between upper and lower lifting limits of the rocker (5), an actualvalue sensor (56) for registering the lifting movement of the rocker (5), and a second controller (R2), which forms with a set value ($n3_s$) dependent on the registered lifting movement a manipulated variable for the speed of the drive (M3) of the first conveying device (1) and thus controls in dependence on the lifting movement of the rocker (5) the volume of printing products per unit of time which is fed to the intermediate stack (29) by the first conveying device (1).

2. The control arrangement as claimed in claim 1, which comprises two limit switches (ES1, ES2), which fix said upper and maximum lower lifting limits, respectively, of the rocker (5) and, upon actuation, in each case switch off or reverse the drive (M2) of the rocker (5).

3. The control arrangement as claimed in claim 2, wherein the first controller (R1) has a first input (54*a*)

for receiving a set value ($n2_s$) for the adjustable speed of the drive (M2) of the rocker (5).

4. The control arrangement as claimed in claim 3, wherein the first input (54*a*) of the first controller (R1) is connected to a speed signal output (53) of a drive (M1) of the second conveying device (32).

5. The control arrangement as claimed in claim 3, wherein the first inout (54*a*) of the first controller (R1) is connected to a potentiometer (55) serving as a set-value generator.

6. The control arrangement as claimed in claim 1, wherein the sensor (LS1) is designed as a light barrier and acts via the first controller (R1) on the drive (M2) of the rocker (5) in such a way that, with interrupted light beam, the rocker (5) is moved downward and, with non-interrupted light beam, the rocker is moved upward, or vice versa.

7. The control arrangement as claimed in claim 1, wherein the actual-value sensor (56) is a pulse generator, which emits at an output (56*a*) a pulse sequence dependent on the magnitude and the direction of the lifting movement of the rocker.

8. The control arrangement as claimed in claim 7, wherein the output (56*a*) of the actual-value sensor (56) is connected at least to a second input (54*b*) of the first controller (R1).

9. The control arrangement as claimed in claim 7, wherein the output (56*a*) of the actual-value sensor (56) is connected to a detector circuit (58), which has a decoder (58*a*) for detecting the lifting movement direction and a counter (58*b*) for counting the pulses from the actual-value sensor (56), and wherein the detector circuit (58) is connected via a D/A converter (59) to a set-value input (60*a*) of the second controller (R2) and delivers to the latter the set value ($n3_s$), from which the second controller (R2) forms the manipulated variable ($n3_f$) for the speed of the drive (M3) of the first conveying device (1) by comparison with its actual speed value ($n3_i$).

10. The control arrangement as claimed in claim 9, which comprises a set-value adjusting device (62) connected between the D/A converter (59) and the set-value input (60*a*) of the second controller (R2).

11. The control arrangement as claimed in claim 10, wherein the set-value adjusting device (62) is a potentiometer.

* * * * *